US010177537B2

(12) United States Patent
Krüger et al.

(10) Patent No.: US 10,177,537 B2
(45) Date of Patent: Jan. 8, 2019

(54) IGNITION SYSTEM FOR AN INTERNAL COMBUSTION ENGINE AND A CONTROL METHOD THEREOF

(71) Applicant: NORTH-WEST UNIVERSITY, Potchefstroom (ZA)

(72) Inventors: Petrus Paulus Krüger, Potchefstroom (ZA); Barend Visser, Potchefstroom (ZA)

(73) Assignee: NORTH-WEST UNIVERSITY, Potchefstroom (ZA)

( * ) Notice: Subject to any disclaimer, the term of this patent is extended or adjusted under 35 U.S.C. 154(b) by 2 days.

(21) Appl. No.: 15/522,258

(22) PCT Filed: Oct. 30, 2015

(86) PCT No.: PCT/IB2015/058391
§ 371 (c)(1),
(2) Date: Apr. 26, 2017

(87) PCT Pub. No.: WO2016/067257
PCT Pub. Date: May 6, 2016

(65) Prior Publication Data

US 2017/0331261 A1 Nov. 16, 2017

(30) Foreign Application Priority Data

Oct. 30, 2014 (ZA) ..... 2014/07931

(51) Int. Cl.
*H01T 13/44* (2006.01)
*H01T 13/50* (2006.01)
(Continued)

(52) U.S. Cl.
CPC ..... *H01T 13/44* (2013.01); *F02P 3/01* (2013.01); *F02P 9/002* (2013.01); *F02P 17/12* (2013.01);
(Continued)

(58) Field of Classification Search
CPC .. F02P 9/002; F02P 9/007; F02P 17/12; F02P 23/04; F02P 3/01; H01T 13/04;
(Continued)

(56) References Cited

U.S. PATENT DOCUMENTS 3,035,108 A * 5/1962 Kaehni ..... F02P 3/01 123/606
3,260,299 A * 7/1966 Lister ..... F23D 14/06 123/651
(Continued)

FOREIGN PATENT DOCUMENTS

CA 2856543 A1 9/2014
FR 3000324 A1 6/2014

OTHER PUBLICATIONS

International Search Report and Written Opinion received in PCT/162015/058391 dated Jan. 18, 2016; 10 pages.
(Continued)

*Primary Examiner* — Hieu T Vo
*Assistant Examiner* — Arnold Castro
(74) *Attorney, Agent, or Firm* — Knobbe, Martens, Olson & Bear LLP

(57) ABSTRACT

An ignition system (10) comprises a high voltage transformer (12) comprising a primary winding (12.1) and a secondary winding (12.2). A primary resonant circuit (26) is formed by the primary winding (12.1) and a primary circuit capacitance (24). A secondary resonant circuit (16) is formed by an ignition plug (14), as a load, the secondary winding (12.2); the ignition plug (14) being represented by a secondary circuit capacitance (18) and a secondary circuit load resistance (Rp) put in parallel. Said load resistance value varies during an ignition cycle. The primary resonant circuit (26) and the secondary resonant circuit (16) have a common mode resonance frequency ($f_c$) and a differential mode resonance frequency ($f_d$). A controller (28) is configured to
(Continued)

cause a drive circuit (22) to drive the primary winding at a frequency, which is either the common-mode resonance frequency ($f_c$) or the differential mode resonance frequency ($f_d$) and is connected to a feed-back circuit (50) to adapt the frequency of the primary winding to the variable load resistance.

9 Claims, 7 Drawing Sheets

(51) Int. Cl.

| | |
|---|---|
| ***F02P 3/01*** | (2006.01) |
| ***F02P 17/12*** | (2006.01) |
| ***H01T 13/04*** | (2006.01) |
| ***H01T 19/00*** | (2006.01) |
| ***H01F 38/12*** | (2006.01) |
| *F02P 9/00* | (2006.01) |
| *F02P 23/04* | (2006.01) |

(52) U.S. Cl.
CPC ..... *H01F 38/12* (2013.01); *H01T 13/04* (2013.01); *H01T 13/50* (2013.01); *H01T 19/00* (2013.01); *F02P 9/007* (2013.01); *F02P 23/04* (2013.01)

(58) Field of Classification Search
CPC ..... H01T 13/44; H01T 13/50; H01T 19/00; H01F 27/00
USPC ..... 315/111.41
See application file for complete search history.

(56) References Cited

U.S. PATENT DOCUMENTS

| | | | | |
|---|---|---|---|---|
| 2004/0129241 | A1* | 7/2004 | Freen | F02C 7/266 123/143 B |
| 2009/0309499 | A1* | 12/2009 | Agneray | F02P 9/007 315/111.21 |
| 2012/0055430 | A1* | 3/2012 | Braeuchle | F02P 23/045 123/143 B |
| 2012/0249006 | A1 | 10/2012 | Burrows | |
| 2013/0049593 | A1 | 2/2013 | Sugino et al. | |
| 2016/0013623 | A1* | 1/2016 | Zheng | H01T 19/04 361/263 |

OTHER PUBLICATIONS

Written Opinion received in PCT/IB2015/058391 dated Oct. 18, 2016; 6 pages.

* cited by examiner

IGNITION SYSTEM FOR AN INTERNAL COMBUSTION ENGINE AND A CONTROL METHOD THEREOF

REFERENCE TO RELATED APPLICATIONS

This application is the U.S. National Phase of International Application PCT/M2015/058391, filed Oct. 30, 2015, and claims priority to ZA Application No. 2014/07931, filed Oct. 30, 2014. Each of the priority applications is hereby incorporated by reference in its entirety.

INTRODUCTION AND BACKGROUND

This invention relates to an ignition system for an internal combustion engine and a method of driving an ignition plug of an ignition system.

In order to improve emissions in petrol internal combustion engines to meet emission standards, the engine needs to be operated with a high exhaust gas recycling (EGR) or lean air-fuel mixtures. A corona ignition plug which improves combustion stability under these conditions is known. However, these plugs cannot be driven by a conventional ignition coil, but must be driven at a high frequency and a high voltage under varying load conditions, as the corona is generated and then grows. The known ignition systems are complicated and expensive. One of the factors making existing corona systems expensive is the requirement that the power delivered to the corona must be controlled carefully, to prevent sparking.

Also, known spark plug ignition systems do not have the capability of controlling the amount of power delivered to a spark. The known systems deliver power proportional to the spark resistance. Because the amount of power delivered to the spark is not controllable and the spark resistance may differ between ignition cycles, the amount of power delivered to the spark may differ between cycles. The differences in power delivered may lead to undesirable differences in ignition and combustion between cycles.

OBJECT OF THE INVENTION

Accordingly it is an object of the invention to provide an ignition system and method of driving an ignition plug with which the applicant believes the aforementioned disadvantages may at least be alleviated or which may provide a useful alternative for the known systems and methods.

SUMMARY OF THE INVENTION

According to the invention there is provided an ignition system comprising:

a high voltage transformer comprising a primary winding having a first inductance $L_1$ and a secondary winding having a second inductance $L_2$;

a primary resonant circuit comprising the primary winding and a primary circuit capacitance $C_1$ and having a first resonant frequency $f_1$;

an ignition plug connected to the secondary winding as a load, in use, to form a secondary resonant circuit comprising the secondary winding, a secondary circuit capacitance $C_2$ and a secondary circuit load resistance Rp, the load resistance, in use and during an ignition cycle, changing between a first value that is high and a second value that is low, the secondary resonant circuit having a second resonant frequency $f_2$;

a drive circuit connected to the primary circuit to drive the primary winding at a drive frequency;

the magnetic coupling k between the primary winding and secondary winding being less than 0.5, so that a resonant transformer comprising the primary resonant circuit and the secondary resonant circuit collectively have a common-mode resonance frequency $f_c$ and a differential-mode resonance frequency $f_d$ when the load resistance is high; and a controller connected to a feed-back circuit from at least one of the primary resonant circuit and the secondary resonant circuit and configured to cause the drive circuit to drive the primary winding at a variable frequency, which is dependent on the load resistance, and which load resistance is derived by the controller from the feed-back circuit.

In one embodiment of the invention the ignition plug is a corona plug for generating a corona only for ignition purposes and the controller may be configured when the load resistance is high, to cause the drive circuit to drive the primary winding at the common-mode resonance frequency to generate a corona and when a spark forms resulting in a low load resistance, to either a) stop driving the primary winding or b) driving the primary winding at a frequency substantially different from a resonance frequency, thereby to stop power transfer into the spark plasma.

In another embodiment of the invention the ignition plug is a spark plug for generating a spark for ignition purposes and the controller may be configured to cause the drive circuit when the load resistance is high, to drive the primary winding at one of the common-mode resonance frequency and the differential-mode resonance frequency thereby generating a high voltage to form a spark and when the load resistance is low, then driving the primary winding at a different frequency to deliver a predetermined amount of power to the load.

In embodiments wherein the drive frequency is equal to the common-mode frequency, the value of $C_1$ may be such that $C_1<L_2C_2/(1+0.5\ k)L_1$, thereby to improve an effective quality factor of the resonant transformer.

In embodiments wherein the drive frequency is equal to the differential-mode frequency, the value of $C_1$ may be such that $C_1>L_2C_2/(1-0.5\ k)L_1$, thereby to improve an effective quality factor of the resonant transformer.

According to another aspect of the invention there is provided a method of driving an ignition system comprising a high voltage transformer comprising a primary winding having a first inductance $L_1$ and a secondary winding having a second inductance $L_2$; a primary resonant circuit comprising the primary winding and a primary circuit capacitance $C_1$ and having a first resonant frequency $f_1$; an ignition plug connected to the secondary winding as a load, in use, to form a secondary resonant circuit comprising the secondary winding, a secondary circuit capacitance $C_2$ and a secondary circuit load resistance Rp, the load resistance, in use and during an ignition cycle, changing between a first value that is high and a second value that is low, the secondary resonant circuit having a second resonant frequency $f_2$; a drive circuit connected to the primary circuit to drive the primary winding at a drive frequency; the magnetic coupling k between the primary winding and secondary winding being less than 0.5, so that a resonant transformer comprising the primary resonant circuit and the secondary resonant circuit collectively have a common-mode resonance frequency $f_c$ and a differential-mode resonance frequency $f_d$ when the load resistance is high, the method comprising:

driving the primary winding at a variable frequency which is dependent on the load resistance.

In some forms of the method the ignition plug is a corona plug for generating a corona only for ignition purposes and the method may comprise when the load resistance is high, driving the primary winding at the common-mode resonance frequency to generate a corona and when a spark forms resulting in a low load resistance, then either a) stop driving the primary winding or b) driving the primary winding at a frequency substantially different from a resonance frequency, thereby to stop power transfer into the spark plasma.

In other forms of the method the ignition plug is a spark plug for generating a spark for ignition purposes and the method may comprise when the load resistance is high, driving the primary winding at one of the common-mode resonance frequency and the differential-mode resonance frequency thereby generating a high voltage to form a spark and when the load resistance is low, then driving the primary winding at a different frequency to deliver a predetermined amount of power to the load.

BRIEF DESCRIPTION OF THE ACCOMPANYING DIAGRAMS

The invention will now further be described, by way of example only, with reference to the accompanying diagrams wherein:

FIG. 6(*b*) show graphs of the common-mode and differential-mode frequency against parallel load resistance for different magnetic coupling coefficients;

FIG. 7(*b*) is similar to FIG. 6(*b*), but with an increase in load capacitance of 20%;

DESCRIPTION OF A PREFERRED EMBODIMENT OF THE INVENTION

Figure 1:
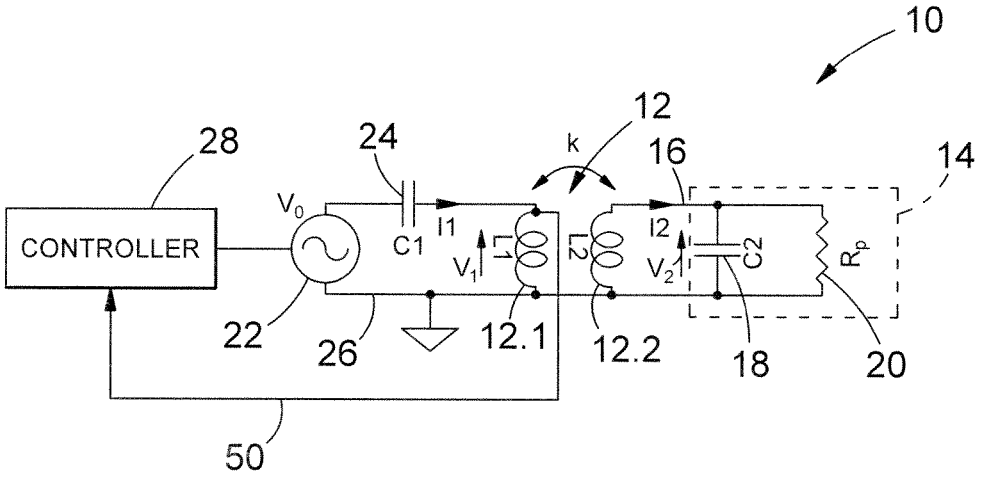
FIG. 1 is a high level circuit diagram of an example embodiment of an ignition system comprising an ignition plug.
Figure 2:
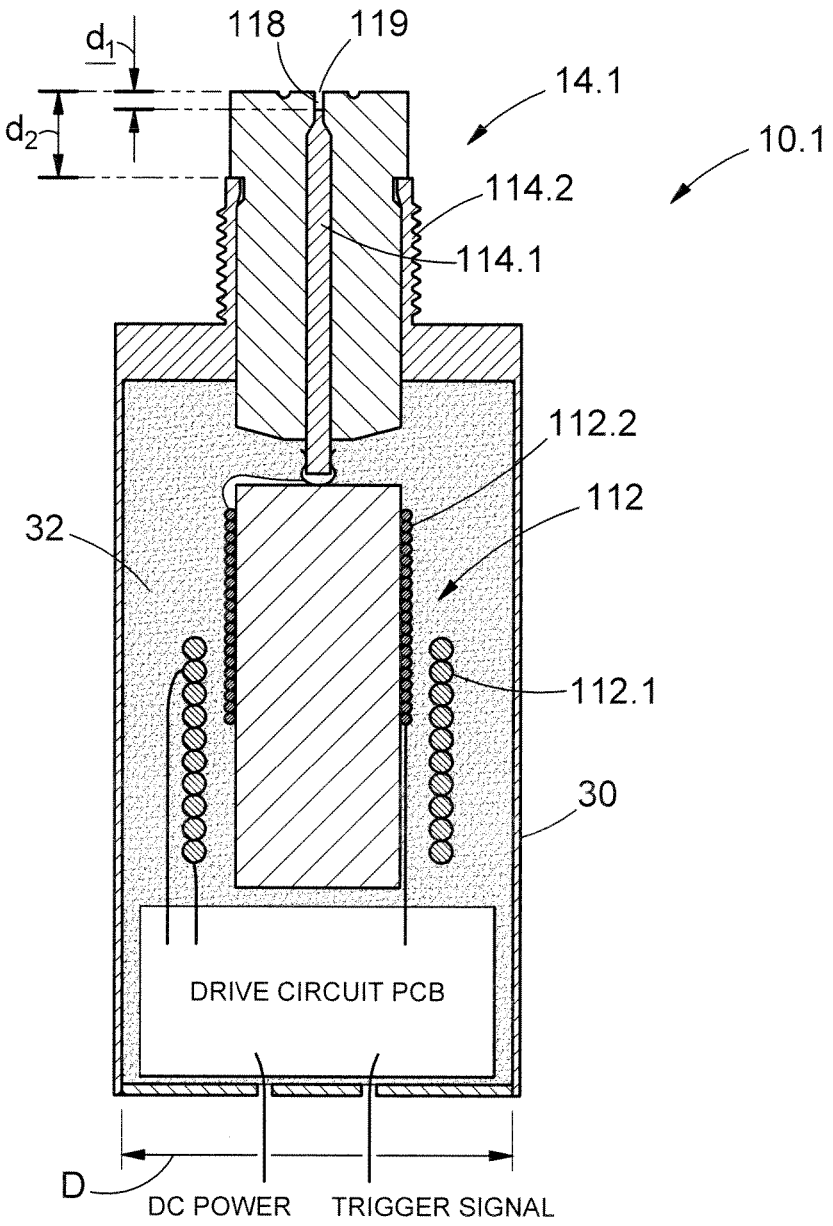
FIG. 2 is a diagrammatic sectional view of an example embodiment of the ignition system comprising an ignition plug in the form of a corona plug.
Figure 3:
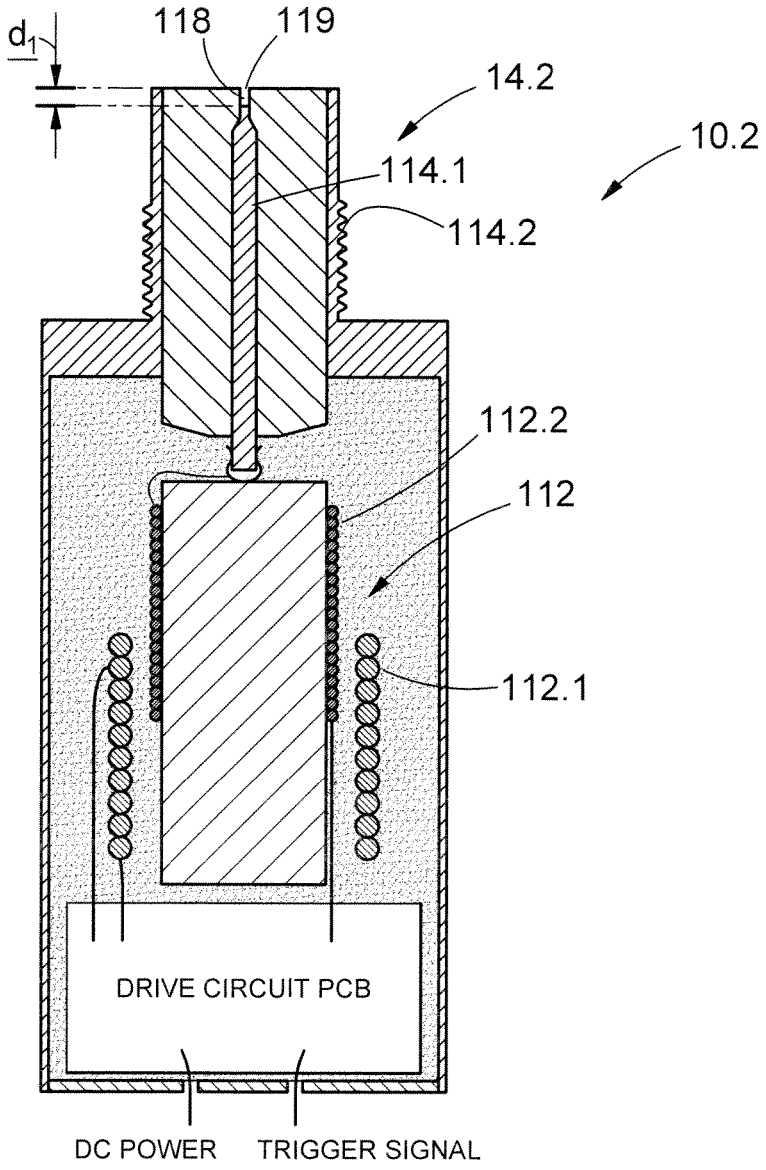
FIG. 3 is a similar view of another example embodiment of the ignition system comprising an ignition plug in the form of a spark plug.
Figure 5:
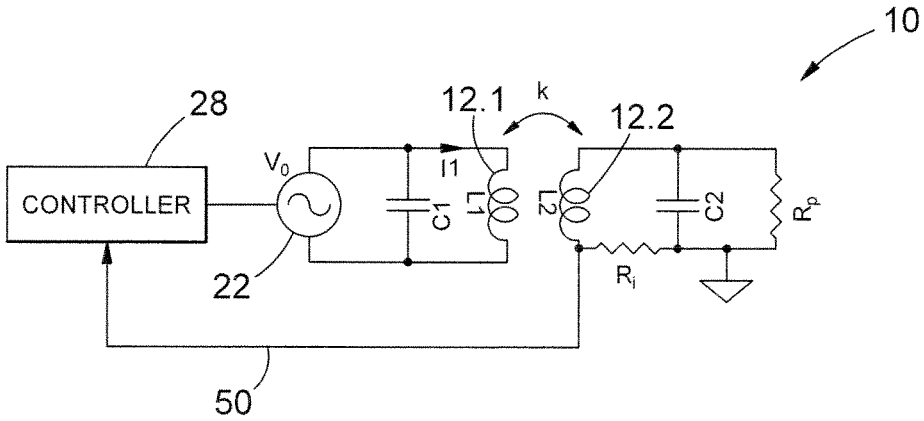
FIG. 5 is another high level circuit diagram of an example embodiment of the ignition system.

Example embodiments of an ignition system are designated 10 in FIGS. 1 and 5, 10.1 in FIGS. 2 and 10.2 in FIG. 3.

Referring to FIG. 1, the ignition system comprises a high voltage transformer 12 comprising a primary winding 12.1 and a secondary winding 12.2. An ignition plug 14 is connected to the secondary winding as a load, in use, to form a secondary resonant circuit 16 comprising the secondary winding 12.2, a secondary circuit capacitance 18 and a load resistance 20 in parallel with the secondary winding 12.2. The load resistance 20 and the load capacitance 18 are mainly provided by the resistance and capacitance of a medium (gas and/or plasma) between electrodes 114.1 and 114.2 (shown in FIGS. 2 and 3) of the ignition plug. It is known that, in use and during ignition, the load resistance changes from a first and high value to a second and lower value and the load capacitance changes from a first and low value to a second and higher value. As a corona is generated at first, the capacitance increases and the load resistance decreases. When a spark is formed, the load resistance is suddenly and dramatically reduced. A capacitor 24 is connected in series with the primary winding 12.1 for a series configuration (see FIG. 1) or in parallel for a parallel configuration (see FIG. 5), to form a primary resonant circuit 26. A drive circuit 22 is connected to the primary circuit to drive the primary winding. The drive circuit may either be a voltage source (for the series configuration) or a current source (for the parallel configuration). The primary resonant circuit 26 has a first resonance frequency $f_1$ which is associated with a first angular resonance frequency and the secondary resonant circuit 16 has a second resonance frequency $f_2$ when the load resistance 20 is large (has its first value) and no second resonance frequency when the load resistance is small (has its second value). The second resonance frequency is associated with a second angular resonance frequency $\omega_2$ and the second resonance frequency $f_2$ may be equal to or different from the first resonance frequency $f_1$. The magnetic coupling coefficient (k) between the primary winding 12.1 and secondary winding 12.2 is less than 0.5, so that a resonant transformer comprising the primary resonant circuit and the secondary resonant circuit has a common-mode resonance frequency $f_c$ (shown in FIG. 4 and explained below) or angular frequency $\omega_c$ and a differential-mode resonance frequency $f_d$ (also shown in FIG. 4 and explained below) or angular frequency $\omega_d$ when the load resistance has its first value, but only the differential-mode resonance frequency $f_d$ when the load resistance approaches its second and low value.

As will be explained in more detail below, a controller 28 which is connected to a feedback circuit 50 from either the primary resonant circuit or the secondary resonant circuit is configured to cause the drive circuit 22 in the case of a corona plug 14.1 (shown in FIG. 2), to drive the primary winding 12.1 at the common-mode resonance frequency $f_c$ to generate a corona and should a spark be formed with the concomitant drop in load resistance, to either i) stop driving the primary winding or ii) driving the primary winding at a frequency substantially different from the common-mode resonance frequency $f_c$, thereby to allow the spark to terminate. The controller can be configured to resume oscillation at the common-mode resonance once the spark is terminated.

In the case of a spark plug 14.2 (shown in FIG. 3), the controller is configured to cause the drive circuit to drive the primary winding 12.1 at one of the common-mode resonance frequency $f_c$ and the differential-mode resonance frequency $f_d$ until the load resistance becomes small and a spark is formed and then to drive the primary winding at a different frequency, to ensure that a predetermined amount of power is delivered to the spark.

Figure 4:
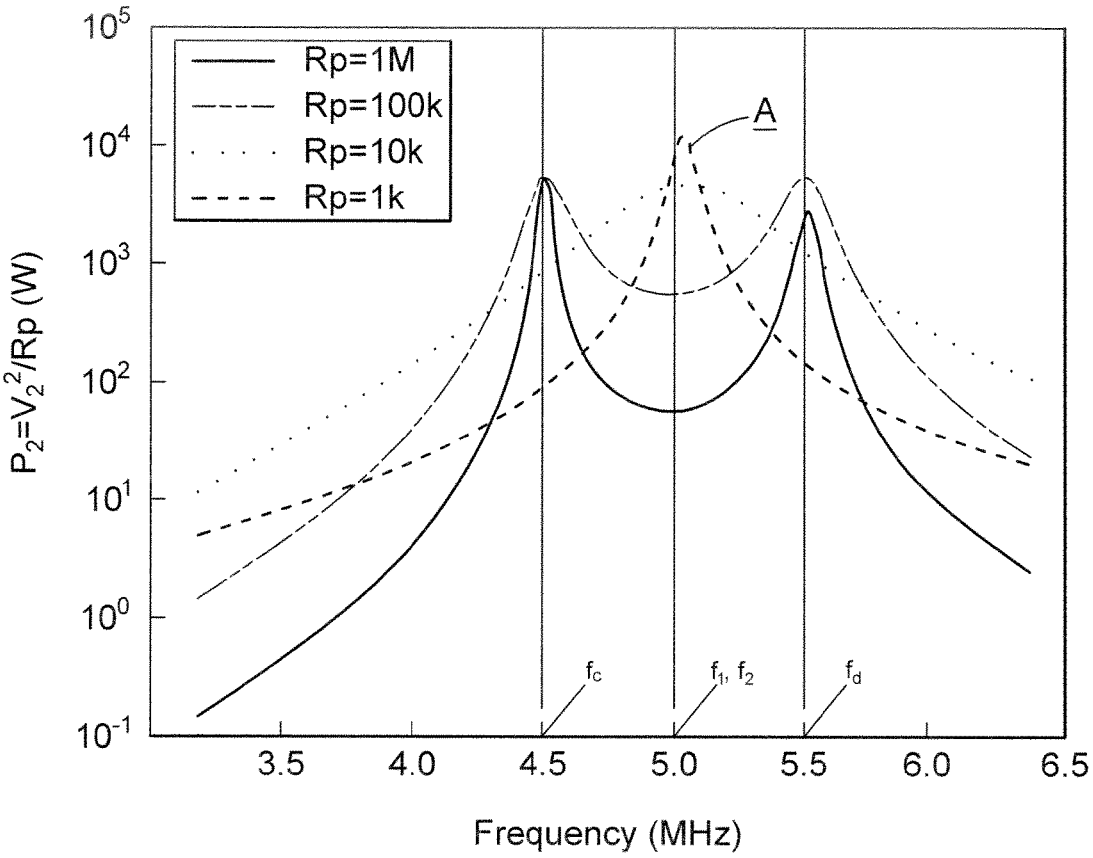
FIG. 4 is a graph of output power against drive frequency for different values of parallel load resistance $R_p$.

Still referring to FIG. 1, transformer 12 has a primary inductance $L_1$ and secondary inductance $L_2$. Series capacitor 24 has a capacitance $C_1$ and the secondary load has a capacitance $C_2$ and parallel resistance $R_p$. It can be shown that when the first resonance frequency $f_1$ (or associated angular resonance frequency $\omega_1$) and the second resonance frequency $f_2$ (or associated angular resonance frequency $\omega_2$) are the same ($\omega_{1,2}=1/L_1C_1=1/L_2C_2$), that the ignition circuit has two resonance frequencies, $$\omega_{c,d} \approx \frac{\omega_{1,2}}{\sqrt{1 \pm k}},$$

wherein $\omega_c$ is referred to as the common-mode resonance frequency (where the current in the primary winding 12.1 and the current in the secondary winding 12.2 are in phase) and $\omega_d$ is referred to as the differential-mode resonance frequency (where the currents are 180 degrees out-of-phase). As shown in FIG. 4, the common-mode resonance frequency $\omega_c$ is lower than the primary and secondary resonance frequencies $\omega_1=\omega_2$, whereas the differential-mode resonance frequency $\omega_d$ is higher than $\omega_1=\omega_2$. Referring to FIG. 4 and the above formula, $f_1=f_2=5$ MHz and k=0.2 give $f_c=4.6$ MHz and $f_d=5.6$ MHz.

Figure 6A:
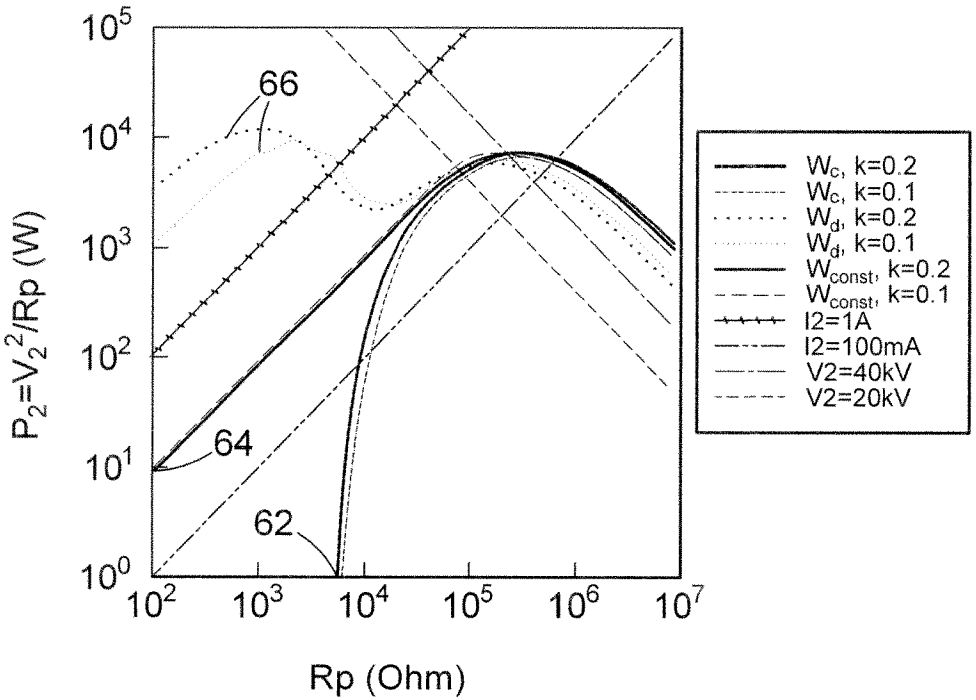
FIG. 6(*a*) show graphs of output power against parallel load resistance for different drive frequencies.
Figure 6B:
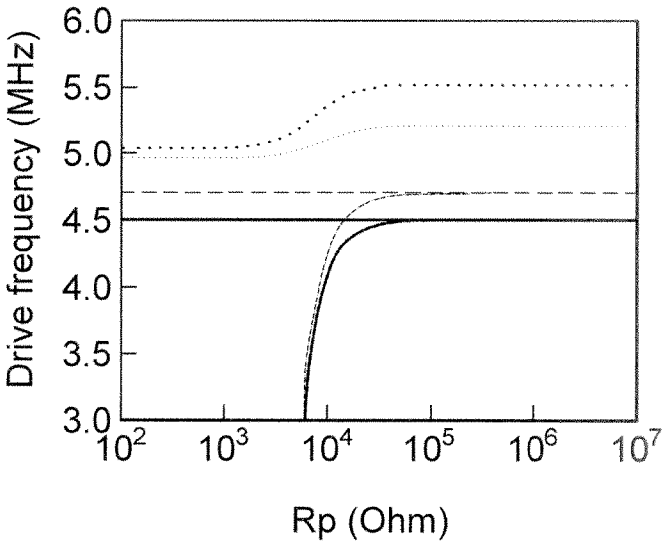

Furthermore, in use, as a corona generated by the ignition plug grows, the load resistance $R_p$ decreases and both $\omega_c$ and $\omega_d$ decrease (as shown in FIG. 6(*b*)). As $R_p$ approaches the value $\omega_2L_2$, the common-mode resonance frequency $\omega_c$ approaches zero and $\omega_d$ approaches $\omega_1$. When $R_p$ is smaller than $\omega_2$–$L_2$, there is no common-mode resonance frequency $\omega_c$, and $\omega_d=\omega_1$. This is also illustrated in FIG. 4 by the broken line marked A.

It can further be shown that the maximum voltage $V_2$ on the secondary side depends on the losses on the primary and secondary side and is almost independent of the magnetic coupling coefficient k. The transformer voltage ratio $|V_2|/|V_1|$ is independent of the coupling coefficient k and is given by the well-known formula $$\frac{|V_2|}{|V_1|} \approx \sqrt{\frac{L_2}{L_1}}.$$

The minimum coupling required is determined by the losses on the primary and secondary sides, and should be such that $k^2>1/Q_1 \cdot 1/Q_2$ where $$Q_1 = \frac{w_1 L_1}{R_1} \text{ and } Q_2 = \frac{w_2 L_2}{R_2}$$

are the quality factors of the primary and secondary circuits. $R_1$ and $R_2$ will be referred to in more detail below.

An example of an ignition system 10.1 for generating a corona is shown in FIG. 2 read with FIG. 1. The system 10.1 comprises a corona plug 14.1 (such as that described in the applicant's co-pending International Application entitled "Ignition Plug", the contents of which are incorporated herein by this reference) connected to a transformer 112. An example of an ignition system 10.2 for generating a spark is shown in FIG. 3 read with FIG. 1. The system 10.2 comprises a spark plug 14.2 connected to a transformer 112.

The transformer comprises 200 secondary winding turns with a diameter of about 10 mm over a length of 20 mm inside a metal tube 30 having a diameter D of about 20 mm filled with a body 32 of non-magnetic material. The secondary winding 112.2 has an inductance of about $L_2=130$ pH. When connected to a corona plug 14.1, the secondary load capacitance is about $C_2=7$ pF, resulting in a secondary resonance frequency of $f_2=\omega_2/2\pi=5.3$ MHz. The primary winding 112.1 comprises 10 winding turns with diameter of about 10 mm having an inductance of about 530 nH, connected to series capacitor 24 having a capacitance $C_1$ of 1.7 nF, resulting in a first resonance frequency of $f_1=\omega_1/2\pi=5.3$ MHz. The coupling coefficient k is determined by the overlap between the windings 112.1 and 112.2 and is typically between k=0.05 and k=0.4. The quality factor of the two resonators (the primary and secondary circuits) is about $Q_1=Q_2=100$, so that the product $Q_2Q_1k^2>25$ for k>0.05. The ignition circuit is driven by a drive circuit outputting a 200V peak-to-peak square wave. The voltage on the primary side winding is then about $V_1=3$ kV and the output voltage is about $V_2=V_1\sqrt{L/L_1}=46$ kV when driven at one of the resonance frequencies for a large load. When the load is 1 MO, the power delivered to the load is $P_2=V^2/R=2$ kW at resonance as shown in FIG. 4.

A normal spark plug can also be used in the place of the spark plug 14.2. However, to prevent unwanted corona on the spark plug ceramic, a lower drive frequency must be utilized. In such a case, the secondary winding 112.2 may comprise 740 turns with a diameter of 10 mm around a ferrite magnetic material, resulting in a secondary inductance of $L_2=7.5$ mH. The secondary side capacitance, including the spark plug capacitance, is about 30 pF, giving a second resonance frequency $f_2$ of 340 kHz. The primary winding 112.1 comprises 12 turns around the same magnetic material, resulting in an inductance of $L_1=4$ pH, and the same resonance frequency $f_1$ of 340 kHz when connected to series capacitor 24 of 56 nF. The ignition circuit is driven by a drive circuit 22 which outputs a 200V peak-to-peak square wave. When driven at resonance for a large load, the voltage on the primary winding is about $V_1=1$ kV and the output voltage is about $V_2=43$ kV.

As shown in FIG. 6(*a*), the power $P_2=V_2^2/R_p$ delivered to the load 14 as a function of the load resistance $R_p$ is determined by the frequency of the drive circuit 22. Using feedback as shown at 50 in FIGS. 1 and 5, the primary winding 12.1 may be driven at the common-mode resonance frequency $f_c$ alternatively differential-mode resonance frequency $f_d$, as they respectively change in use. Alternatively, the system 10 may be driven at a constant frequency $f_{const}$, such as 4.5 MHz as shown in FIG. 6(*b*). The power as function of resistance is shown in FIG. 6(*a*) for these three cases.

From FIG. 6(*a*) it can be seen that driving the system at the common-mode resonance frequency $f_c$ will inherently suspend power transfer when the load resistance becomes small, as shown at 62. Hence the system and method inherently reduce the power the moment a spark is formed. Driving the circuit at the constant frequency $f_{const}$ will deliver a constant current into small loads as shown at 64 and driving the system at the differential-mode resonance frequency $f_d$ will result in very high power delivered into small loads as shown at 66.

Figure 7B:
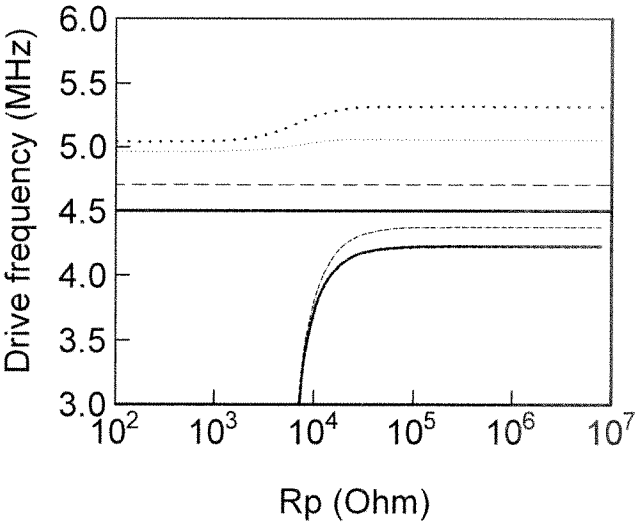
FIG. 7(*a*) is similar to FIG. 6(*a*), but with an increase in load capacitance of 20%.
Figure 7A:
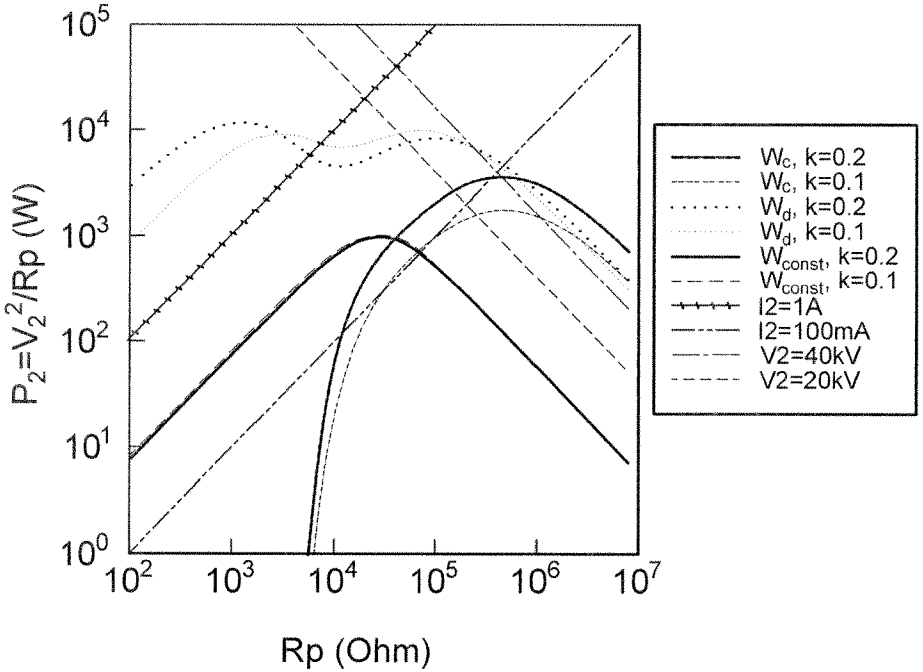

The effect of changes in load capacitance $C_2$ as the corona grows can be seen by increasing the secondary capacitance by 20% for example, thereby reducing the common-mode resonance frequency by about 10% as shown in FIG. 7(*b*). When the drive frequency is fixed to the common-mode resonant frequency without the extra capacitance, the system will not be driven at resonance any more with the extra capacitance. This will result in a much lower high voltage $V_2$ than driving the system at the common-mode resonance frequency $f_c$.

The drive circuit 22 can be configured to oscillate at the common-mode (or differential-mode) frequency by sensing, as shown in FIG. 5, the secondary current and driving the primary circuit 26 in phase (or 180 degrees out of phase) with the secondary current.

Hence, two weakly coupled resonators may be used to generate a high voltage in an ignition system. With the controller 28 causing the drive circuit 22 to follow the changing common-mode or differential-mode resonance frequencies as the load changes, the amount of power transferred to the load may be controlled. There is the unexpected result in a corona ignition system that when the system is driven at the common-mode resonance frequency, power transfer is inherently reduced the moment a spark is formed, as shown at 62 in FIG. 6(*a*).

As stated above, the primary winding 12.1 is connected to capacitor $C_1$ in either series (FIG. 1) or parallel (FIG. 5) and to drive circuit 22. The capacitance $C_1$ and inductance $L_1$ form a first resonant circuit having a first angular resonant frequency $\omega_1^2=1/L_1C_1$. Due to losses in the first resonant circuit, the circuit has a first quality factor $C_1$, so that the losses at an angular frequency $\omega$ can be presented by an equivalent series resistance $R_1$ given by $Q_1=\omega L_1/R_1$, or an equivalent parallel resistance.

The secondary winding is connected to load 14 such as an ignition plug. The capacitance of the secondary winding and load can be presented by parallel capacitor $C_2$. The loss of the secondary winding and the resistance of the load can be presented by parallel resistor $R_p$. The capacitance $C_2$ and inductance $L_2$ forms a resonant circuit having a secondary angular resonant frequency $\omega_2^2=1/L_2C_2$. The quality factor $Q_2$ of the secondary side at an angular frequency $\omega$ is given by $Q_2=R_p/\omega L_2$. The description below relates to a case when the resistance $R_p$ is large, i.e. when there is not a spark between the electrodes of the ignition plug.

Due to the magnetic coupling between the primary and secondary windings, the first and second circuits form a combined resonant circuit, called a resonant transformer. This resonant transformer does not resonate as either the first angular frequency $\omega_1$ or secondary angular frequency $\omega_2$, but has two other resonant frequencies, called the common-mode resonant frequency $f_c$ and the differential-mode resonant frequency $f_d$ (as shown in FIG. 4 for $R_p$>100 kΩ).

Figure 8:
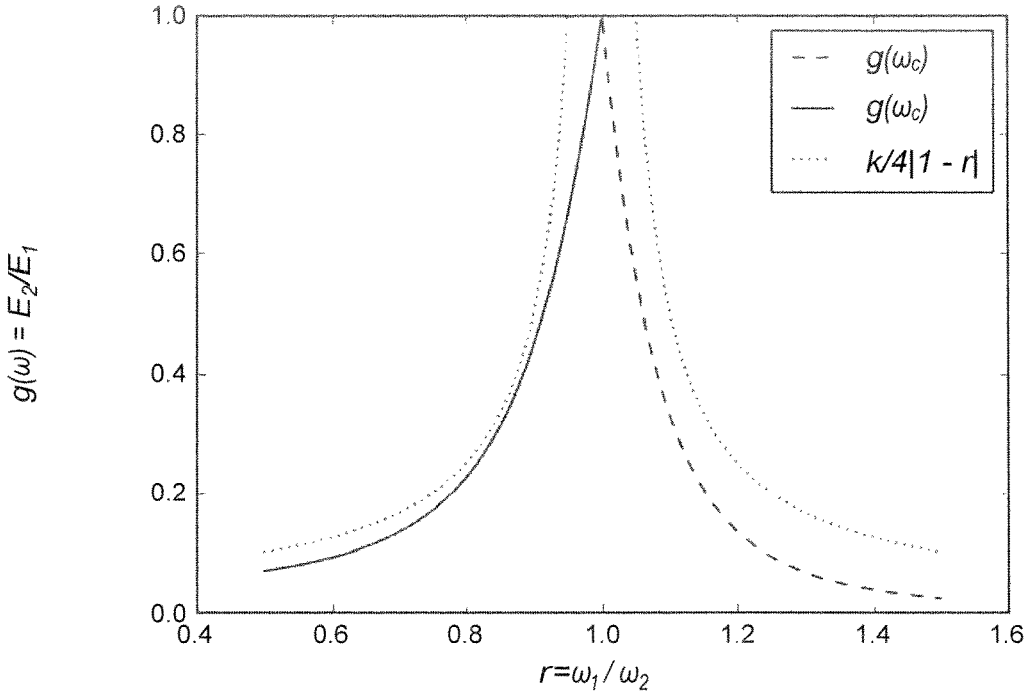
FIG. 8 are normalized graphs illustrating changes in common-mode resonant frequency $\omega_c$ and differential-mode resonant frequency $\omega_d$ as first and second resonant frequencies change relative to one another.

For the special case when the first and secondary angular frequencies are the same $\omega_1=\omega_2$ (i.e. $L_1C_1=L_2C_2$) the common-mode angular resonant frequency is given by $\omega_c^2/(1+k)$ and the differential-mode angular resonant frequency is given by $\omega_d^2=^2/(1-k)$. However as $\omega_1$ becomes larger than $\omega_2$ ($\omega_1>\omega_2$) the common-mode frequency becomes closer to the second resonant frequency $\omega_c\rightarrow\omega_2$ and the differential-mode frequency becomes closer the first resonant frequency $\omega_d\rightarrow\omega_1$. Similarly, as $\omega_1$ becomes smaller than $\omega_2$ ($\omega_1<\omega_2$), $\omega_c\rightarrow\omega_1$ and $\omega_d\rightarrow\omega_2$. This is shown in the FIG. 8 where the frequencies are normalised with respect to $\omega_2$.

When the resonant transformer is driven at any one of its two resonant frequencies, the primary current $I_1$ (FIG. 1) is in phase with the supply voltage $V_0$ and a push-pull drive circuit 22 may be switched at zero current when connected in series as in FIG. 1, or it switches at zero voltage when connected in parallel as in FIG. 5. This has the first advantage that switching losses are small.

A second advantage of the resonant transformer being driven at resonance is that each oscillation cycle transfers energy to the secondary circuit so that the energy (and therefore high voltage) in the secondary circuit builds up with each additional cycle until steady state is achieved when the energy loss equals the energy transferred during each cycle. The result is that the energy in the secondary circuit is much more than the energy supplied by the drive circuit during each cycle. This can be presented by the equation $|V_2||I_2|=Q_{eff}V_0I_1$, where the power in the secondary circuit is presented by the product of the magnitudes of the secondary voltage $|V_2|$ and secondary current $|I_2|$, the supplied power is given by $V_0$ and $I_1$ (which are in phase) and $Q_{eff}>1$ is the effective quality factor of the resonant transformer. To generate a spark or to grow a corona, a secondary voltage of about 30 kV is required. This means that the larger $Q_{eff}$, the smaller (less powerful) drive circuit can be used to generate the same output voltage, which is cheaper, simpler and more reliable than a more powerful drive circuit.

Resonant transformers having $\omega_1=\omega_2$ are commonly used in so-called Tesla coils. However, when $\omega_1=\omega_2$ (i.e. $L_1C_1=L_2C_2$), the effective quality factor at both the common- and differential-mode resonant frequencies are determined by the quality factors of both the primary and secondary circuit of the transformer i.e. $Q_{eff}\approx Q_1Q_2/(Q_1+Q_2)$ or $Q_{eff}^{-1}=Q_1^{-1}Q_2^{-1}$. The primary winding normally consists of only a few turns and the current in the primary winding is much more than in the secondary winding. The result is that the primary circuit has more losses than the secondary circuit, $Q_1<Q_2$ so that the effective quality factor $Q_{eff}<Q_1<Q_2$, which is unwanted.

However, when $\omega_1\neq\omega_2$ we have the unexpected effect that the effective quality factor $Q_{eff}$ increases at one of the common- and differential-mode resonant frequencies and decreases at the other one. The effective quality factor at the common and differential-mode frequency can be written as $Q_{eff}^{-l}(\omega_c)\approx g(\omega_c)Q_1^{-1}+Q_2^{-1}$ and $Q_{eff}^{-1}(\omega_d)\approx g(\omega_d)Q^{-1}Q_2^{-1}$ with the function $g(\omega)=(-\omega_2^2/w\ 1)^2/k^2$. The function $g(\omega)$ can be interpreted as the ratio of the energy stored in the secondary and primary resonant circuits. It is therefore clear that as either the common- or differential-mode resonant frequency approaches $\omega_2$, i.e. $\omega_{c,d}\rightarrow C_2$, the effective quality factor at that resonance approach $Q_2$, i.e. $Q_{eff}(\omega_{c,d})\rightarrow C_2$.

Figure 9:
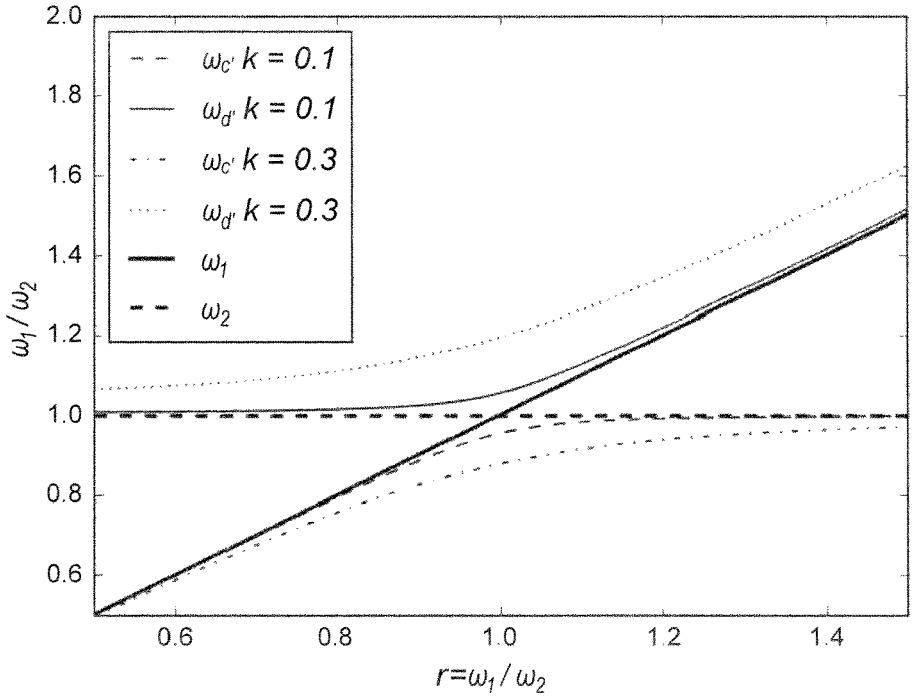
FIG. 9 are graphs illustrating values of a factor $g(\omega)$ against a ratio of the first and second resonant frequencies.

Let $\omega_1$ be larger or smaller than $\omega_2$ by a factor r, i.e. $\omega_1\approx\omega_2$. It can then seen from FIG. 9 that as $\omega_1$ becomes larger than $\omega_2$ ($\omega_1<\omega_2$), $g(\omega_c)\rightarrow 0$, $Q_{eff}(\omega_c)\rightarrow Q_2$ and the common-mode resonance become more efficient and as $\omega_1$ becomes smaller than $\omega_2$ ($\omega_1<\omega_2$) $g(\omega_d)\rightarrow 0$, $Q_{eff}(\omega_d)\rightarrow Q_2$ and the differential-mode resonance becomes more efficient.

The figure also shows that $g\leq k/(4||-\omega_1/\omega_2|)$. This makes it possible to estimate the improvement in the effective quality factor in terms of $\omega_1^2=1/L_1C_1$ and $\omega_2^2=1/L_2C_2$.

The effect of $Q_1$ will be at least two (2) times smaller ($g<½$) at the differential-mode resonance when $k/4(1-r)<½$, i.e. when $L_2C_2<(1-½k)L_1C_1$ and the effect of $Q_1$ will be less than half at the common-mode resonance when $L_2C_2>(1+½)L_1C_1$.

The effect of $Q_1$ will be at least 4 times smaller ($g<¼$) at the differential-mode resonance when $k/(4(1-r))<¼$, i.e. when $L_2C_2<(1-k)L_1C_1$ and the effect of $Q_1$ will be less than half at the common-mode resonance when $L_2C_2>(1+k)L_1C_1$.

Example embodiments of a corona plug and a spark plug are shown in FIGS. 3 and 2, respectively. These example embodiments may comprise an elongate cylindrical body of an electrically insulating material having a first end and a second end opposite to the first end. A first face is provided at the first end. A first elongate electrode 114.1 extends longitudinally in the body. The first electrode has a first end and a second end. The first electrode terminates at the first end thereof a first distance d1 from the first end of the body in a direction towards the second end of the body. The body hence defines a blind bore 118 extending between the first end of the first electrode and a mouth 119 at the first end of the body. A second electrode 114.2 is provided on an outer surface of the body and the second electrode terminates at one of a) flush with the first face of the body (for a spark plug as shown in FIG. 3) and b) a second distance d2 from the first end of the body in a direction towards the second end of the body (for a corona plug as shown in FIG. 2).

The generated spark extends between the first and second electrodes through the mouth 119 into a chamber with ignitable gasses where in at least part of its extent, it is surrounded by the gasses. The corona extends from the first electrode through the mouth 119 in finger like manner into the chamber, where in at least part of its length it is surrounded by the gasses.

The invention claimed is:

1. An ignition system comprising:

a high voltage transformer comprising a primary winding having a first inductance $L_1$ and a secondary winding having a second inductance $L_2$;

a primary resonant circuit comprising the primary winding and a primary circuit capacitance $C_1$ and having a first resonant frequency $f_1$;

an ignition plug connected to the secondary winding as a load, in use, to form a secondary resonant circuit comprising the secondary winding, a secondary circuit capacitance $C_2$ which comprises capacitance of the secondary winding and capacitance presented by the load and a secondary circuit load resistance Rp which comprises losses in the secondary winding and resistance presented by the load, the secondary circuit load resistance, in use and during an ignition cycle, changing between a first value that is high and a second value that is low, the secondary resonant circuit having a second resonant frequency $f_2$;

a drive circuit connected to the primary circuit to drive the primary winding;

the magnetic coupling k between the primary winding and secondary winding being less than 0.5, so that a resonant transformer comprising the primary resonant circuit and the secondary resonant circuit collectively have a common-mode resonance frequency $f_c$ and a differential-mode resonance frequency $f_d$ when the load resistance is high; and a controller connected to a feed-back circuit from at least one of the primary resonant circuit and the secondary resonant circuit and configured to cause the drive circuit, during an ignition cycle, to drive the primary winding at a variable frequency, which is dependent on the changing secondary circuit load resistance, and which changing secondary load resistance is derived by the controller from the feed-back circuit.

2. The ignition system as claimed in claim 1 wherein the ignition plug is a corona plug for generating a corona only for ignition purposes and wherein the controller is configured when the load resistance is high to cause the drive circuit to drive the primary winding at the common-mode resonance frequency to generate a corona and when a spark forms resulting in a low load resistance, to either a) stop driving the primary winding or b) driving the primary winding at a frequency substantially different from a resonance frequency, thereby to stop power transfer into the spark plasma.

3. The ignition system as claimed in claim 1 wherein the ignition plug is a spark plug for generating a spark for ignition purposes and wherein the controller is configured to cause the drive circuit when the load resistance is high to drive the primary winding at one of the common-mode resonance frequency and the differential-mode resonance frequency thereby generating a high voltage to form a spark and when the load resistance is low, then driving the primary winding at a different frequency to deliver a predetermined amount of power to the load.

4. The system as claimed in claim 2 wherein when the drive frequency is equal to the common-mode frequency, the value of $C_1$ is such that $C_1<L_2C_2/(1+0.5\ k)L_1$, thereby to improve an effective quality factor of the resonant transformer.

5. The system as claimed 3 wherein when the drive frequency is equal to the differential-mode frequency, the value of $C_1$ is such that $C_1>L_2C_2/(1-0.5\ k)L_1$, thereby to improve an effective quality factor of the resonant transformer.

6. A method of driving an ignition system comprising a high voltage transformer comprising a primary winding having a first inductance L1 and a secondary winding having a second inductance L2; a primary resonant circuit comprising the primary winding and a primary circuit capacitance C1 and having a first resonant frequency $f_1$; an ignition plug connected to the secondary winding as a load, in use, to form a secondary resonant circuit comprising the secondary winding, a secondary circuit capacitance $C_2$ which comprises capacitance of the secondary winding and capacitance presented by the load and a secondary circuit load resistance Rp which comprises losses in the secondary winding and resistance presented by the load, the secondary circuit load resistance, in use and during an ignition cycle, changing between a first value that is high and a second value that is low, the secondary resonant circuit having a second resonant frequency $f_2$; a drive circuit connected to the primary circuit to drive the primary winding at a drive frequency; the magnetic coupling k between the primary winding and secondary winding being less than 0.5, so that a resonant transformer comprising the primary resonant circuit and the secondary resonant circuit collectively have a common-mode resonance frequency $f_c$ and a differential-mode resonance frequency $f_d$ when the load resistance is high, the method comprising:

during an ignition cycle, driving the primary winding at a variable frequency which is dependent on the changing secondary circuit load resistance.

7. A method as claimed in claim 6 wherein the ignition plug is a corona plug for generating a corona only for ignition purposes and wherein when the load resistance is high, the primary winding is driven at the common-mode resonance frequency to generate a corona and when a spark forms resulting in a low load resistance, then either a) stop driving the primary winding or b) driving the primary winding at a frequency substantially different from a resonance frequency, thereby to stop power transfer into the spark plasma.

8. A method as claimed in claim 6 wherein the ignition plug is a spark plug for generating a spark for ignition purposes and wherein when the load resistance is high, the primary winding is driven at one of the common-mode resonance frequency and the differential-mode resonance frequency thereby generating a high voltage to form a spark and when the load resistance is low, then driving the primary winding at a different frequency to deliver a predetermined amount of power to the load.

9. The system as claimed in claim 3 wherein when the drive frequency is equal to the common-mode frequency, the value of $C_1$ is such that $C_1 < L_2C_2/(1+0.5\ k)L_1$, thereby to improve an effective quality factor of the resonant transformer.

* * * * *